US009542789B2

(12) United States Patent
Chen

(10) Patent No.: US 9,542,789 B2
(45) Date of Patent: Jan. 10, 2017

(54) PAPER CURRENCY ACCOMMODATING DEVICE

(71) Applicant: GRG Banking Equipment Co., Ltd., Guangzhou, Guangdong (CN)

(72) Inventor: Dengli Chen, Guangdong (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 15/021,927

(22) PCT Filed: Oct. 24, 2014

(86) PCT No.: PCT/CN2014/089397
§ 371 (c)(1),
(2) Date: Mar. 14, 2016

(87) PCT Pub. No.: WO2015/096544
PCT Pub. Date: Jul. 2, 2015

(65) Prior Publication Data

US 2016/0225217 A1 Aug. 4, 2016

(30) Foreign Application Priority Data

Dec. 24, 2013 (CN) ..... 2013 1 0723629

(51) Int. Cl.
*G07F 7/04* (2006.01)
*G07D 11/00* (2006.01)
(Continued)

(52) U.S. Cl.
CPC ..... *G07D 11/0018* (2013.01); *B65H 31/02* (2013.01); *B65H 31/26* (2013.01);
(Continued)

(58) Field of Classification Search
CPC ..... B65H 2402/45; B65H 31/26; B65H 29/58; B65H 2404/63; G07D 11/0018; G07D 11/0081; G07D 11/0003; G07D 11/0006; G07D 11/0009; G07D 11/0012; G07D 11/0015; G07D 11/0024; G07D 11/0027; G07D 11/0033; G07F 1/02
(Continued)

(56) References Cited

U.S. PATENT DOCUMENTS 5,249,793 A * 10/1993 Scheufler ..... B65H 29/14 271/188
5,388,818 A * 2/1995 Anton ..... G03B 42/04 206/455
(Continued)

FOREIGN PATENT DOCUMENTS

CN 1525407 A 9/2004
CN 1594052 A 3/2005
(Continued)

OTHER PUBLICATIONS

Written Opinion, dated Jan. 30, 2015, from corresponding International Application No. PCT/CN2014/089397.
(Continued)

*Primary Examiner* — Jeffrey Shapiro
(74) *Attorney, Agent, or Firm* — Wolf, Greenfield & Sacks, P.C.

(57) ABSTRACT

A banknote accommodating device includes a box body, a box door and a banknote inlet. A movable guide plate in the box body is arranged below the banknote inlet through a rotating shaft, and has a guide surface facing the banknote inlet, and an included angle between the guide surface and a vertical direction ranges from 0 degree to 20 degrees, an elastic element is provided on a back surface of the guide surface, and provides a thrust to rotate the movable guide plate counterclockwise. The box door is provided with a guide rib which forms an included angle with the vertical direction, and a stacking surface is provided at the bottom of
(Continued)

the box body and forms an included angle with a horizontal direction, and a space for stacking banknotes vertically is formed between the guide surface, the guide rib and the stacking surface.

4 Claims, 7 Drawing Sheets

(51) Int. Cl.
*B65H 31/02* (2006.01)
*B65H 31/26* (2006.01)
*G07F 19/00* (2006.01)

(52) U.S. Cl.
CPC .. *G07F 19/202* (2013.01); *B65H 2301/42146* (2013.01); *B65H 2402/31* (2013.01); *B65H 2402/543* (2013.01); *B65H 2402/545* (2013.01); *B65H 2402/5441* (2013.01); *B65H 2701/1912* (2013.01); *G07D 11/0006* (2013.01); *G07D 11/0012* (2013.01); *G07D 11/0027* (2013.01); *G07D 11/0033* (2013.01)

(58) Field of Classification Search
USPC 194/206, 207, 344, 346, 350, 351; 209/534; 235/379; 271/220, 303
See application file for complete search history.

(56) References Cited

U.S. PATENT DOCUMENTS 5,520,379 A * 5/1996 Tanjo ..... G03G 15/602 271/3.08
5,564,691 A * 10/1996 Hatamachi ..... B65H 29/46 271/178
5,829,673 A 11/1998 Harr, Jr.
5,924,808 A * 7/1999 Sides, II ..... B65H 31/22 271/209
6,158,565 A * 12/2000 Mikami ..... G07F 7/04 194/206
6,394,444 B1 * 5/2002 Ito ..... B65H 29/16 271/178
2002/0070496 A1 6/2002 Ito et al.
2005/0189266 A1 * 9/2005 Fujita ..... G07F 19/205 209/534
2008/0236989 A1 10/2008 Kondou et al.
2009/0127064 A1 * 5/2009 Marquet ..... G07F 9/06 194/206
2009/0184458 A1 7/2009 Bisone et al.

FOREIGN PATENT DOCUMENTS

CN 1645421 A 7/2005
CN 101276495 A 10/2008
CN 101378980 A 3/2009
CN 102436691 A 5/2012
CN 103381977 A 11/2013
CN 103700182 A 4/2014
JP 2000072311 A 3/2000
JP 2000172903 A 6/2000

OTHER PUBLICATIONS

International Search Report, dated Jan. 19, 2016, from corresponding International Application No. PCT/CN2014/089397.

* cited by examiner

PAPER CURRENCY ACCOMMODATING DEVICE

This application is the national phase of International Application No. PCT/CN2014/089397, titled "PAPER CURRENCY ACCOMMODATING DEVICE", filed on Oct. 24, 2014, which claims priority to Chinese Patent Application No. 201310723629.4 titled "BANKNOTE ACCOMMODATING DEVICE", filed with the Chinese State Intellectual Property Office on Dec. 24, 2013, which applications are hereby incorporated by reference to the maximum extent allowable by law.

FIELD

The present application relates to a financial self-service apparatus, and particularly to an accommodating device for sheet-type media.

BACKGROUND

A financial self-service apparatus, such as an automatic teller machine, relates to a processing device for recovering, accommodating and stacking banknotes. A conventional banknote recovering device stacks banknotes horizontally when accommodating the banknotes, thus having a large capacity and also a large volume, and a power device is generally required to be provided in the banknote recovering device to assist in stacking banknotes. However, with the minimization of the automatic teller machine, the space for accommodating banknotes is relatively limited, therefore, it is difficult to stack the banknotes horizontally in recovering and accommodating the banknotes. Hence, it is necessary to provide a banknote accommodating device which has a small volume, does not require a power device for assisting in stacking, and is suitable for stacking banknotes vertically.

SUMMARY

To address the technical issues in the conventional technology that the banknote accommodating device has a large volume and cannot meet the requirement of minimization of a financial self-service apparatus, a banknote accommodating device is provided according to the present application, which has a function of accommodating banknotes vertically, and significantly reduces the volume of the space for accommodating the banknotes.

The banknote accommodating device includes a box body, a box door, and a banknote inlet. A switching member and a pair of pressing roller components are provided at the banknote inlet, the switching member is configured to selectively rotate to open or close the banknote inlet under the control of a control signal, and the pair of pressing roller components are configured to convey banknote into the banknote accommodating device in a state that the banknote inlet is open. A movable guide plate is provided in the box body, and is arranged below the banknote inlet through a rotating shaft, the rotating shaft is fixedly mounted to a side wall of the box body, a guide surface of the movable guide plate faces the banknote inlet, and an included angle formed between the guide surface of the movable guide plate and a vertical direction ranges from 0 degree to 20 degrees, an elastic element is provided on a back surface of the guide surface of the movable guide plate, and the elastic element is configured to provide a thrust to the movable guide plate to allow the movable guide plate to rotate counterclockwise. The box door is provided with a guide rib which forms an included angle ranging from 0 degree to 30 degrees with respect to the vertical direction, and a stacking surface is provided at the bottom of the box body and forms an included angle ranging from 0 degree to 45 degrees with respect to a horizontal direction, and a space for stacking banknotes vertically is formed between the guide surface of the movable guide plate, the guide rib of the box door and the stacking surface at the bottom of the box body.

Preferably, a guide surface is further provided in an upper portion at a left side of the box body, and an included angle formed between the guide surface of the box body and the vertical direction ranges from 0 degree to 20 degrees, and is configured to guide the banknote to move from the banknote inlet to the guide surface of the movable guide plate.

Optionally, the elastic element includes a compression spring, a leaf spring or a torsion spring.

The space for stacking the banknotes vertically is formed between the guide surface of the movable guide plate, the guide ribs of the box door and the stacking surface at the bottom of the box body, thus the banknotes can be stacked vertically, and the box body of the banknote accommodating device may be designed relatively small, to meet the requirement of minimization of the financial self-service device. Furthermore, with the design of the movable guide plate and the elastic element on its back surface allows the size of the banknote stacking space to be adjustable, and with the increasing of the stacked banknotes, the elastic element provides a thrust to the stacked banknotes, to press the stacked banknotes tightly, to accommodate more banknotes.

DETAILED DESCRIPTION OF THE EMBODIMENTS

For further illustrating a banknote accommodating device according to the present application, the banknote accommodating device is further described in detail hereinafter in conjunction with illustrations of preferred embodiments of the present application.

Figure 7:
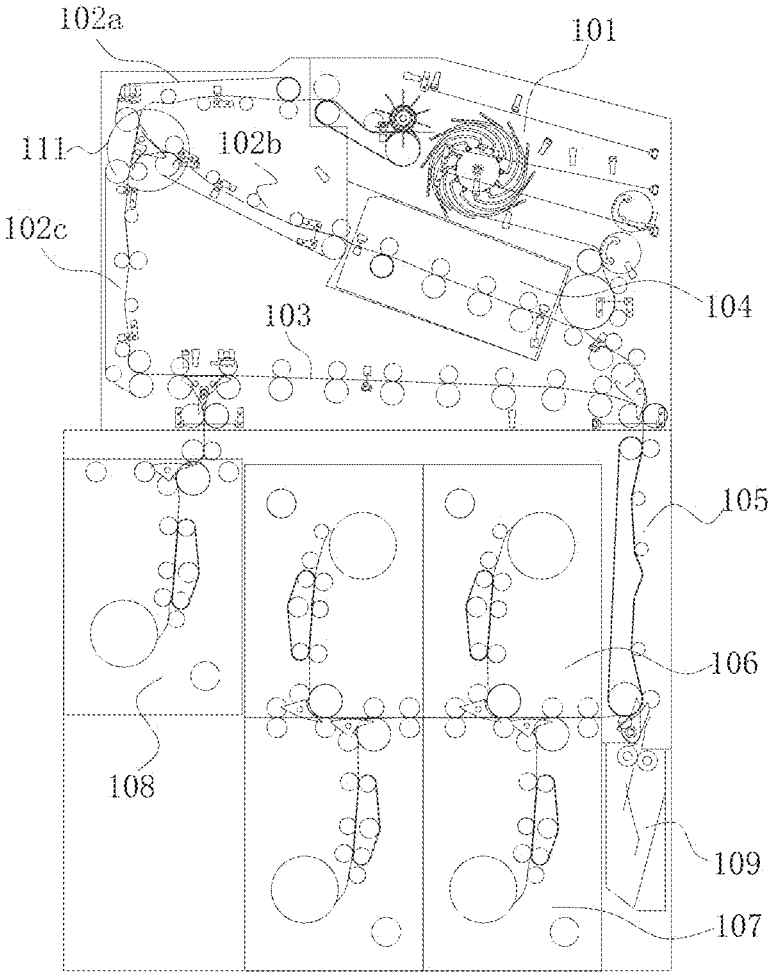
FIG. 7 is a schematic view showing the internal structure of a cash recycling system which employs the banknote accommodating device according to the present application.

Referring to FIG. 7, the banknote accommodating device according to this embodiment is employed in a cash recycling system. The cash recycling system includes a banknote inlet module 101, an upper portion upper passage module 102 (102 consists of 102*a*, 102*b*, and 102*c*, and a three-way switching component 111 is mounted on the upper portion upper passage module 102), an upper portion lower passage module 103, a banknote identification module 104, a lower portion passage module 105, a conveying passage 105, an upper drum-type cashbox 106, a lower drum-type cashbox 107, an audit drum-type cashbox 108, and a banknote accommodating device 109.

When a customer fails to take away the banknotes in the banknote inlet module 101 within a preset time span in depositing or withdrawing the banknotes, the cash recycling system sends a command to recover the banknotes in the banknote inlet module 101, and the recovered banknotes are separated and then individually enter into the conveying passage, and enter into the banknote identification module 104 via the conveying passage, and then enter into the upper portion upper passage module 102*b*, the three-way switching component 111, the upper portion upper passage module 102*c*, the upper portion lower passage module 103, and the lower portion passage module 105 in the listed sequence. A switching member 1 in the lower portion passage module 105 rotates by a certain angle counterclockwise under the action of a rotational electromagnet, to be in a state 1*b* (referring to FIG. 1), and the passage leading to the banknote accommodating device 109 is opened.

Figure 1:
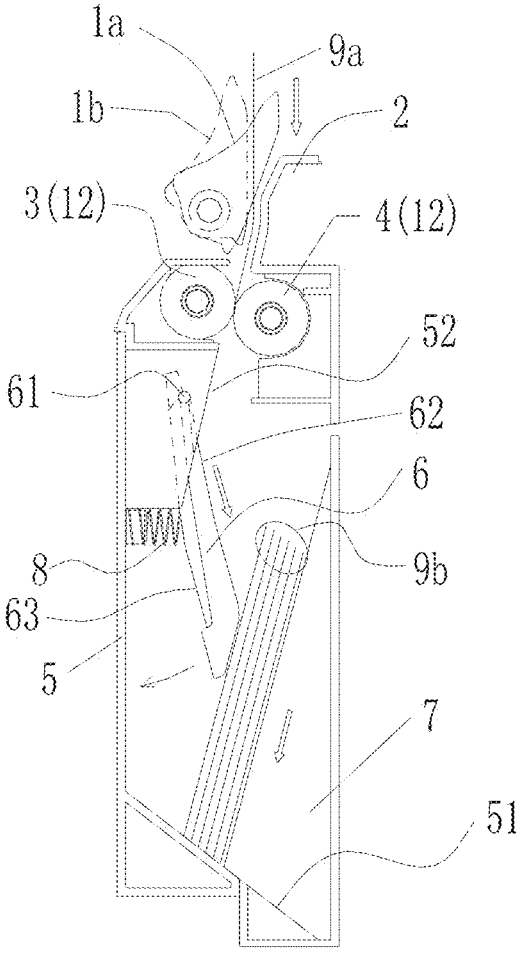
FIG. 1 is a side view of a banknote accommodating device according to a first embodiment of the present application.
Figure 2:
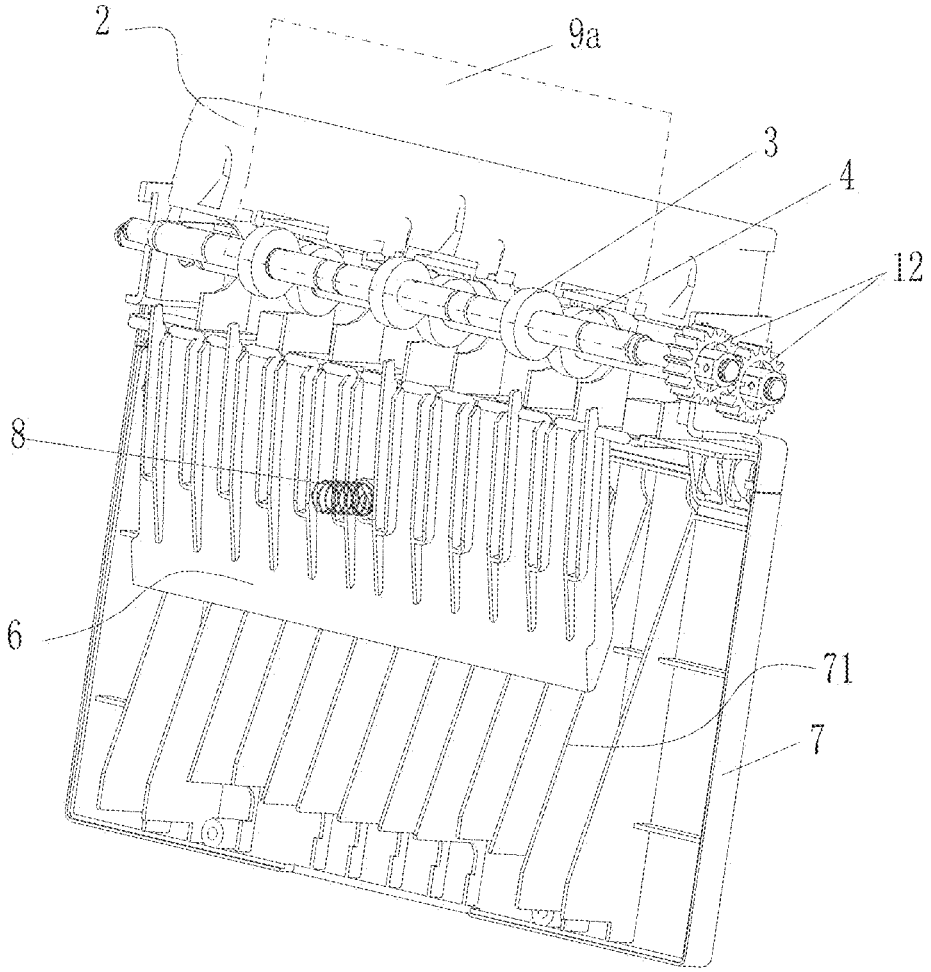
FIG. 2 is a perspective schematic view of the banknote accommodating device in FIG. 1, which omits a box body and mainly shows the form and mounting position of an elastic element.

Referring to FIGS. 1 and 2, the banknote accommodating device 109 according to a preferred embodiment of the present application includes a box body 5, a box door 7 and a banknote inlet; the switching member 1 (including two states 1*a* and 1*b*), a box cover 2 and a pair of pressing roller components 3 and 4 are provided at the banknote inlet. The banknote inlet consists of a passage formed by a right side guide surface of the switching member 1 and a left side surface of the box cover 2, and the pair of pressing roller components 3 and 4 are arranged below the banknote inlet. The switching member 1 is controlled by a control signal to selectively rotate to open or close the banknote inlet, and the pair of pressing roller components 3 and 4 convey the banknote 9*a* into the box body 5 of the banknote accommodating device 109 in the state that the banknote inlet is open. The pressing roller components 3 and 4 are each driven by a spur gear 12. A movable guide plate 6 is provided in the box body 5, and is arranged below the banknote inlet 2 through a rotating shaft 61. The rotating shaft 6 is fixedly mounted to a side wall of the box body 5, and a guide surface 62 of the movable guide plate 6 faces the banknote inlet 2, and an included angle formed between the guide surface 62 and a vertical direction ranges from 0 degree to 20 degrees. An elastic element is provided on a back surface 63 of the guide surface 62. The elastic element in this embodiment is a spring 8, and the spring 8 applies a thrust on the movable guide plate 6 to allow the movable guide plate 6 to rotate counterclockwise. The box door 7 is provided with a guide rib 71 which forms an included angle ranging from 0 degree to 30 degrees with respect to the vertical direction. A stacking surface 51 is provided at the bottom of the box body 5, and forms an included angle ranging from 0 degree to 45 degrees with respect to a horizontal direction. A space for stacking banknotes vertically is formed between the guide surface 62 of the movable guide plate 6, the guide rib 71 of the box door 7 and the stacking surface 51 at the bottom of the box body 5. The state of the banknotes being stacked vertically in this space is indicated as 9*b*.

Preferably, a guide surface 52 is further provided in an upper portion at a left side of the box body 5, an included angle formed between the guide surface 52 and the vertical direction ranges from 0 degree to 20 degrees, and is configured to guide the banknote 9*a* to move from the banknote inlet to the guide surface 62 of the movable guide plate 6. The banknote 9*a* enters along the passage formed by the right side surface of the switching member 1*b* and the left side surface of the box cover 2, and is conveyed into the box body 5 by the pressing roller component 3 and the pressing roller component 4, and then moves onto the guide surface 62 (a rightward inclined surface in the drawings) of the movable guide plate 6 along the guide surface 52 in the upper portion at the left side of the box body 5, and then the banknote continues to slide downwards to the guide rib 71 of the box door 7. Under the combined effects of the movable guide plate 6, the box door 7, the compression spring 8 and the self-gravity of the banknote, a front end of the banknote rests on the stacking inclined surface 51 at the bottom of the box body 5, and the entire sheet of banknote is stacked well against the surface of the guide rib 71 of the box door 7. With continuously entering of the received banknotes, the banknotes are stacked in the state 9*b*. When the banknotes are stacked to a certain thickness, the banknotes entered later will press the movable guide plate 6, to make the movable guide plate 6 to rotate clockwise about its center of rotation (the rotating shaft 61) in a direction as indicated by an arrow in FIG. 1 by a certain small angle, to make room for the banknotes entered later. Meanwhile, since the compression spring 8 is compressed, it generates a certain reaction force to push the guide plate 6 to allow the guide plate 6 to have a trend of rotating counterclockwise, to press the stacked banknotes tightly, thereby accommodating more banknotes.

Figure 3:
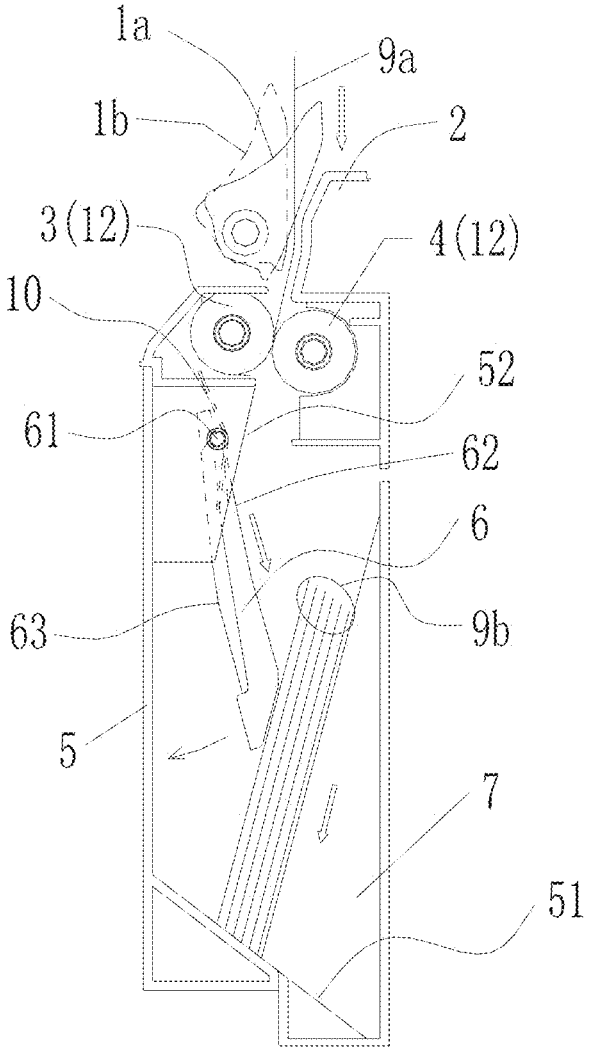
FIG. 3 is a side view of a banknote accommodating device according to a second embodiment of the present application.
Figure 4:
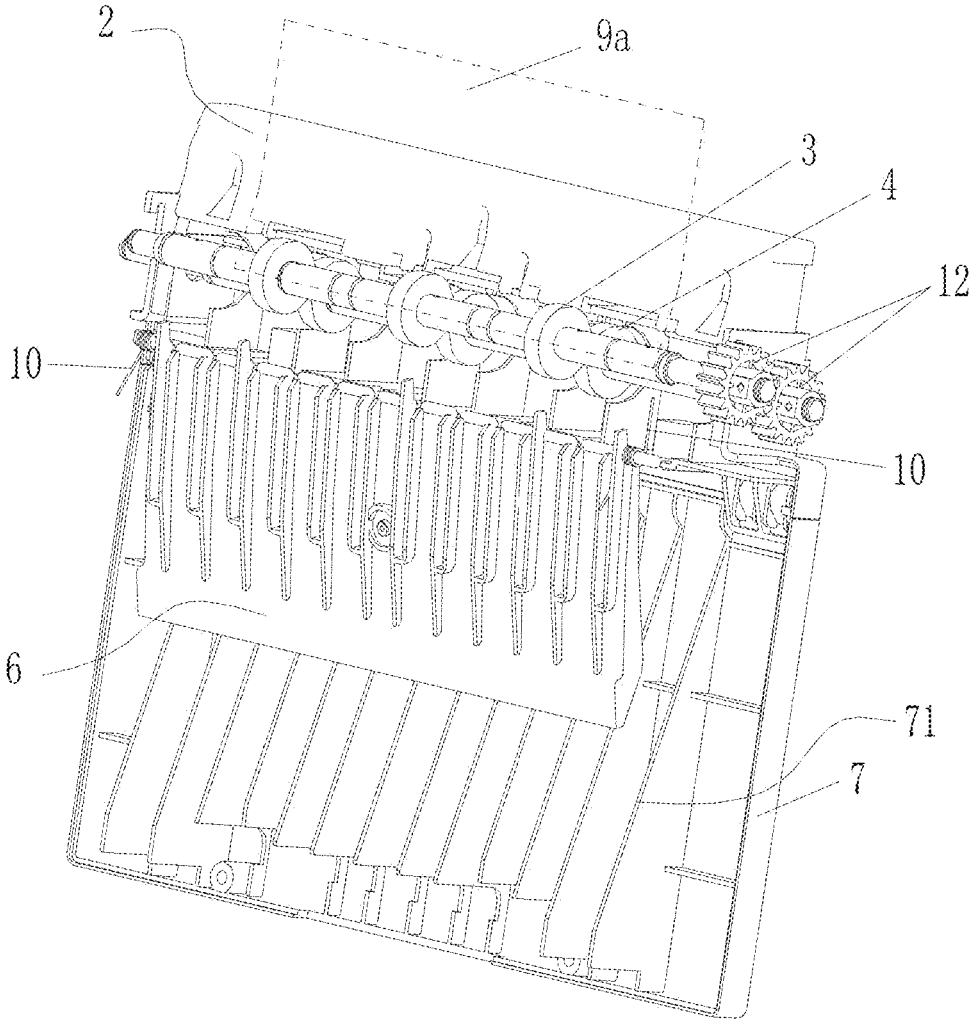
FIG. 4 is a perspective view of the banknote accommodating device in FIG. 3, which omits a box body and mainly shows the form and mounting position of an elastic element.

As shown in FIGS. 3 and 4, a second embodiment is further provided according to the present application. Unlike the banknote accommodating device according to the first embodiment, in the banknote accommodating device according to this embodiment, a torsion spring 10 is adopted to replace the compression spring 8, and the torsion spring 10 provides a reaction force to push the guide plate 6 to allow the guide plate 6 to have a trend of rotating counterclockwise, to press the stacked banknotes tightly. As shown in FIG. 4, the number of the torsion springs 10 is two, and the two torsion springs 10 are sleeved symmetrically on two ends of the rotating shaft 61 of the movable guide plate 6, and a torque arm of each torsion spring 10 extends towards a back side of the movable guide plate 6 to press against the side wall of the box body 5, thereby providing a reaction force to the movable guide plate.

Figure 5:
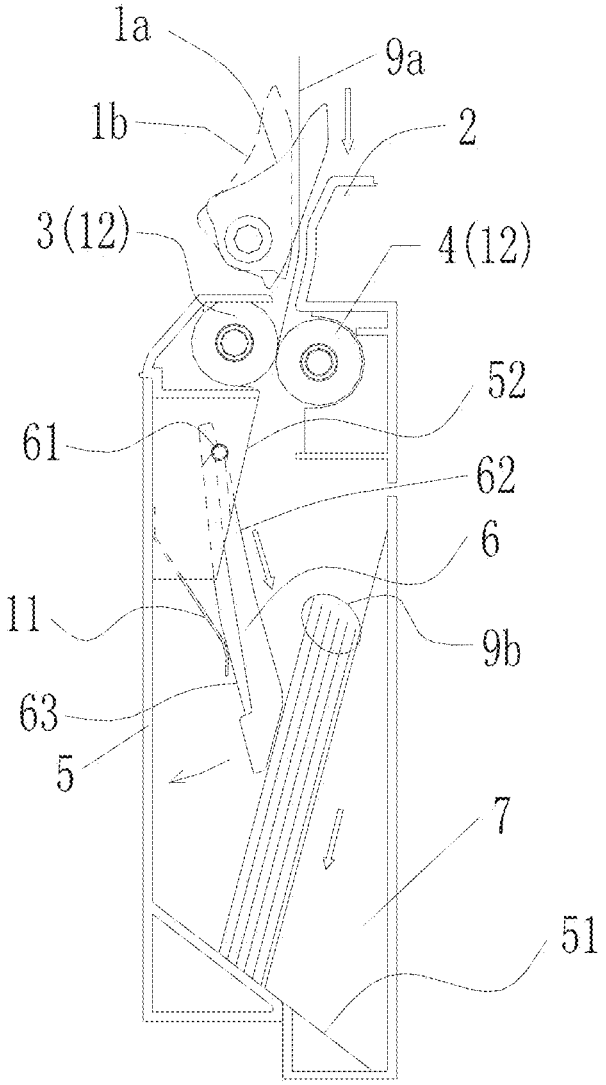
FIG. 5 is a side view of a banknote accommodating device according to a third embodiment of the present application.
Figure 6:
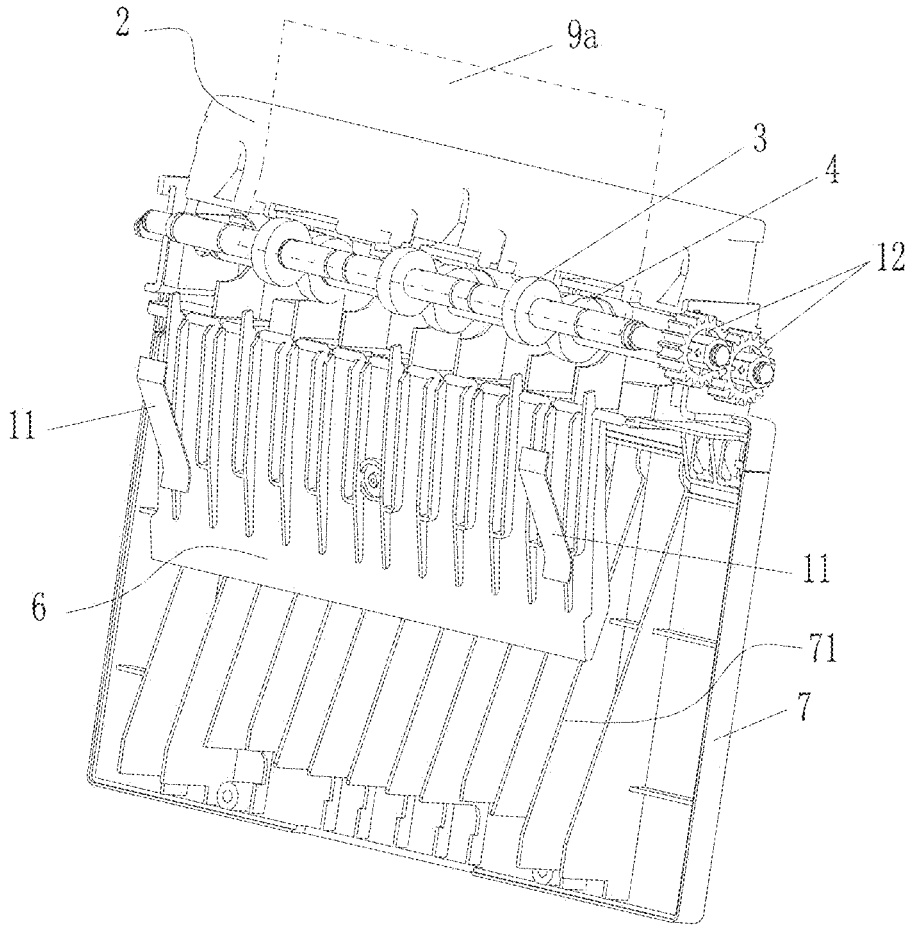
FIG. 6 is a perspective view of the banknote accommodating device in FIG. 5, which omits a box body and mainly shows the form and mounting position of an elastic element.

As shown in FIGS. 5 and 6, a third embodiment is further provided according to the present application. Unlike the banknote accommodating device according to the first embodiment, in the banknote accommodating device according to this embodiment, a leaf spring 11 is adopted to replace the compression spring 8, and the leaf spring 11 provides a reaction force to push the guide plate 6 to allow the guide plate 6 to have a trend of rotating counterclockwise, to press the stacked banknotes tightly. As shown in FIG. 6, the number of the leaf springs 11 is two, and the two leaf springs 11 are fixed on the back surface 63 of the movable guide plate 6 bilaterally symmetrically.

The space for stacking the banknotes vertically is formed between the guide surface 62 of the movable guide plate 6, the guide ribs 71 of the box door 7 and the stacking surface 51 at the bottom of the box body 5, thus the banknotes can be stacked vertically, and the box body of the banknote accommodating device may be designed relatively small, to meet the requirement of minimization of the financial self-service device. Furthermore, with the design of the movable guide plate 6 and the elastic element on its back surface allows the size of the banknote stacking space to be adjustable, and with the increasing of the stacked banknotes, the elastic element provides a thrust to the stacked banknotes, to press the stacked banknotes tightly, to accommodate more banknotes.

The above description is only preferred embodiments of the present application. It should be noted that, the above preferred embodiments should not be deemed as a limitation to the present application, and the scope of the present application is defined by the claims of the present application. For the person skilled in the art, several improvements and modifications may be made to the present application without departing from the spirit and scope of the present application, and these improvements and modifications are also deemed to fall into the scope of the present application.

The invention claimed is:

1. A banknote accommodating device, comprising a box body, a box door, and a banknote inlet, a switching member and a pair of pressing roller components being provided at the banknote inlet, the switching member being configured to selectively rotate to open or close the banknote inlet under the control of a control signal, and the pair of pressing roller components being configured to convey banknote into the banknote accommodating device in a state that the banknote inlet is open, wherein, a movable guide plate is provided in the box body, and is arranged below the banknote inlet through a rotating shaft, the rotating shaft is fixedly mounted to a side wall of the box body, a guide surface of the movable guide plate faces the banknote inlet, and an included angle formed between the guide surface of the movable guide plate and a vertical direction ranges from 0 degree to 20 degrees, an elastic element is provided on a back surface of the guide surface of the movable guide plate, and the elastic element is configured to provide a thrust to the movable guide plate to allow the movable guide plate to rotate counterclockwise; and the box door is provided with a guide rib which forms an included angle ranging from 0 degree to 30 degrees with respect to the vertical direction, and a stacking inclined surface is provided at the bottom of the box body and forms an included angle ranging from 0 degree to 45 degrees with respect to a horizontal direction, and a space for stacking banknotes vertically is formed between the guide surface of the movable guide plate, the guide rib of the box door and the stacking surface at the bottom of the box body;

wherein a front end of a banknote rests on the stacking inclined surface at the bottom of the box body, and the entire sheet of the banknote is stacked well against a surface of the guide rib.

2. The banknote accommodating device according to claim 1, wherein a guide surface is further provided in an upper portion at a left side of the box body, and an included angle formed between the guide surface of the box body and the vertical direction ranges from 0 degree to 20 degrees, and is configured to guide the banknote to move from the banknote inlet to the guide surface of the movable guide plate.

3. The banknote accommodating device according to claim 1, wherein the elastic element comprises a compression spring, a leaf spring or a torsion spring.

4. The banknote accommodating device according to claim 2, wherein the elastic element comprises a compression spring, a leaf spring or a torsion spring.

* * * * *